United States Patent [19]

Doi et al.

[11] Patent Number: 4,847,653

[45] Date of Patent: Jul. 11, 1989

[54] TRIBOELECTRICALLY CHARGING MEMBER

[75] Inventors: Isao Doi; Hideo Hotomi; Toshiya Natsuhara, all of Osaka, Japan

[73] Assignee: Minolta Camera Kabushiki Kaisha, Osaka, Japan

[21] Appl. No.: 164,437

[22] Filed: Mar. 4, 1988

[30] Foreign Application Priority Data

Mar. 5, 1987 [JP] Japan ..... 62-52259

[51] Int. Cl.[4] ..... G03G 15/08

[52] U.S. Cl. ..... 355/245; 355/259

[58] Field of Search ..... 355/3 DD, 14 D, 14 CH, 355/3 CH; 118/647, 657

[56] References Cited

U.S. PATENT DOCUMENTS 4,521,098 6/1985 Hosoya et al. ..... 355/3 DD
4,528,937 7/1985 Kanno et al. ..... 355/3 DD X
4,575,220 3/1986 Sakamoto et al. ..... 355/3 DD
4,632,535 12/1986 Nagata ..... 355/3 DD

FOREIGN PATENT DOCUMENTS 58-132769 8/1983 Japan .
61-176961 8/1986 Japan .

*Primary Examiner*—A. C. Prescott
*Attorney, Agent, or Firm*—Burns, Doane, Swecker & Mathis

[57] ABSTRACT

The disclosure relates to a triboelectrically charging member including a surface formed with an amorphous carbon film containing at least carbon, hydrogen and fluorine atoms. The amorphous carbon film is formed by plasma polymerization with a glow discharge method.

The triboelectrically charging member of the present invention has high hardness, is excellent in friction resistance and can retain a good copy image quality over time.

8 Claims, 3 Drawing Sheets

TRIBOELECTRICALLY CHARGING MEMBER

BACKGROUND OF THE INVENTION

1. Field of the Invention

The present invention relates to a triboelectrically charging member.

2. Description of the Prior Art

Triboelectrically charging members are used in a variety of fields and are generally desirable due to their excellent triboelectrical chargeability, superior friction and heating resistance, and the stability of their triboelectric charging function over time.

These characteristics of triboelectrically charging members are specifically required in the field of electrophotographic developing apparatus. In dry developing apparatus which are monocomponent developers in particular, each time toner passes between the triboelectrically charging member and the developing roller, the toner must be uniformly thinned and adequately charged.

Conventional triboelectrically charging members (i.e., a toner thickness regulating member) are subject to various disadvantages such as when toner fused by frictional heating adheres to the surface of the charging member as a mass or film. Further disadvantages include markedly reduced copy image quality when so-called white streaks, black streaks, filming, grainy fog and the like, appear in the copy image, said defects being induced by uneven toner thickness, insufficient toner charging and uneven charging which are resulted from the defects that the triboelectrically charging member becomes worn or its surface is damaged over time due to toner-induced friction. Manufactured triboelectrically charging members in monocomponent dry developing systems have a further disadvantage in that they are constructed by affixing a film or sheet made from selected materials to an elastic metal substrate and therefore film component deformation and film separation at the ends of said member readily occur which gives rise to the aforesaid defects causing reductions in copy image quality.

Unexamined Japanese Patent Publications Sho 58-132769 and Sho 61-176961, for example, disclose the selections of poly-4-ethylene flouride resin or ethylene and 4-ethylene flouride copolymers as means for improving the release properties of the triboelectrically charging members. However, the triboelectrically charging members disclosed in these publications do not simultaneously fulfill requirements for release properties and friction resistance.

SUMMARY OF THE INVENTION

A main object of the present invention is to provide a triboelectrically charging member which has a high degree of hardness, is excellent in friction resistance and which can retain copy image quality over time.

Another object of the invention is to provide a triboelectrically charging member which has superior release properties and can prevent adhesion of fused toner.

A further object of the invention is to provide a triboelectrically charging member which has superior chargeability and durability with regard to deformation and separation.

A still further object of the invention is to provide a triboelectrically charging member which can supply a toner layer of uniform thickness to the developing roller, and which can produce high resolution copy images with minimal fogging over time.

These and other objects of the present invention are achieved by providing a triboelectrically charging member covered by plasma-polymerized amorphous carbon film containing at least carbon, hydrogen and fluorine atoms.

DETAILED DESCRIPTION OF THE PREFERRED EMBODIMENTS

The triboelectrically charging member of the present invention functions effectively as a toner mixing member, developing roller, photosensitive member cleaning blade, and image transfer roller, but is not limited to the above uses. The member of the invention is especially well suited for use as a triboelectrically charging member in electrophotographic developing apparatus which employ monocomponent developers.

Figure 1:
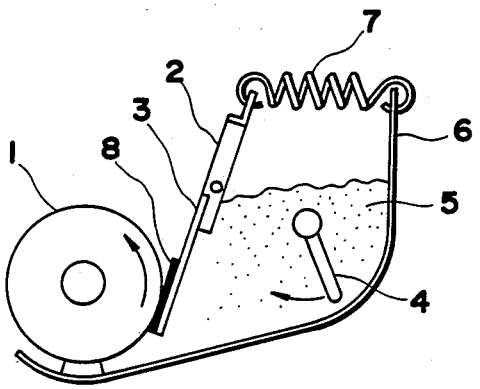
FIG. 1 shows an example of the construction of an electrophotographic developing apparatus using a triboelectrically charging member.

The construction of a conventional monocomponent developing apparatus is briefly shown in FIG. 1.

Toner 5 within the toner tank 6 is delivered via the mixing member 4 to the toner layer thickness regulating region formed by the developing roller 1 and the plate-like toner thickness regulating member 3. The toner thickness regulating member 3 is rotatably supported by support fixture 2. The triboelectrically charging member 8 is provided upon the toner thickness regulating member 3, and makes pressure contact with the developing roller 1 via the action of spring 7. Developing roller 1 and triboelectrically charging member 8 have a fixed quantity of toner passing therebetween so as to produce friction, whereby a thin layer of charged toner having a specified thickness is formed upon the surface of said developing roller 1. The charged toner is delivered by developing roller 1 to a region opposite an electrically conductive member or a photosensitive member which maintains an electrically latent image thereon, the toner then being selectively transferred to said member so as to develop the electrically latent image.

In the present invention, the surface of the aforesaid triboelectrically charging member is covered by a plasma-polymerized amorphous carbon film containing at least carbon, hydrogen and fluorine atoms.

The covering film may be obtained by plasma polymerization of a single compound containing at least fluorine atoms, hydrogen atoms and carbon atoms (hereinafter referred to as "fluorine-incorporating organic compound"). The covering film may also be formed by plasma polymerization of a mixture containing a fluorine compound such as a fluorine-incorporating compound (a fluorine compound may be, generally speaking, a compound containing fluorine but not hydrogen such as tetrafluoroethylene, in lieu of the aforesaid fluorine-incorporating organic compound) and a compound containing at least carbon and hydrogen atoms (compounds containing alcohol or like atoms may be used, generally speaking, in lieu of hydrocarbons) so as to form a plasma-polymerized film on the surface of the triboelectrically charging member. Plasma polymerization may be accomplished by vaporizing the aforesaid compounds and effecting a glow-discharge decomposition reaction in a vacuum, but is not specifically limited to this method, and may be accomplished by other suitable plasma polymerization means.

Concrete examples of useful compounds capable of supplying fluorine other than the aforesaid fluorine-incorporating organic compounds are, for example, oligomers such as tetrafluoroethylene, tetrafluoromethane, hexafluoroethane, hexafluorocyclobutane, hexafluoropuropene, octafluorobutene, hexafluorocyclobutene and perfluoroalkene, and useful organic compounds containing halogens in addition to fluorine are, for example, monobromotrifluoromethane, trichlorotrifluoroethane, monochlorotrifluoroethylene and the like. Compounds containing oxygen and sulfur atoms and the like may also be used.

Fluorine-incorporating organic compounds are compounds containing at least fluorine, carbon and hydrogen atoms, and may include partially fluorinated hydrocarbons, for example, monofluoromethane, difluoroethane, trifluoroethane, monofluoroethylene, monofluorobenzene and the like. Other halogens containing oxygen or sulfur may also be used; useful compounds are methacrylates and acrylates which contain fluorine atoms such as, for example, 2,2,2-trifluoroethylmethacrylate [$CH_2{=}C(CH_3)COOCH_2CF_3$], 2,2,3,3,-tetrafluoropropylmethacrylate [$CH_2{=}C(CH_3)COOCH_2(CF_2)_2H$], 1H,1H,5H-octafluoropentylmethacrylate [$CH_2{=}C(CH_3)COOCH_2(CF_2)_4H$], 1H,1H,2H,2H-heptadecafluorodecylmethacrylate [$CH_2{=}C(CH_3)COO(CH_2)_2(CF_2)F_6$], 2,2,2-trifluoroethylacrylate [$CH_2{=}CHCOOCH_2CF_3$], 2,2,3,3-tetrafluoropropylacrylate [$CH_2{=}CHCOOCH_2(CF_2)_2H$], 1H,1H,5H-octafluoropentylacrylate [$CH_2{=}CHCOOCH_2(CF_2)_4H$, 1H,1H,2H,2H-heptadecafluorodecylacrylate [$CH_2{=}CHCOO(CH_2)_2(CF_2)_8F$] and the like. Flourine compounds containing hydrogen, i.e. fluorine-incorporating organic compounds, may be used singly, or when fluorine compounds do not contain hydrogen that may be used together with other compounds containing hydrogen and carbon as necessary.

Compounds containing hydrogen and carbon are, for example, saturated hydrocarbons, unsaturated hydrocarbons, alicyclic hydrocarbons, aromatic hydrocarbons and the like, as well as alcohols, ketones, carboxyls, amines, amides, esters, ethers, halogenated hydrocarbons and the like.

A wide variety of hydrocarbons are usable. Examples of useful saturated hydrocarbons are normal paraffins, such as methane, ethane, propane, butane, pentane, hexane, heptane, octane, nonane, decane, undecane, dodecane, tridecane, tetradecane, pentdecane, hexadecane, heptadecane, octadecane, nonadecane, eicosane, heneicosane, docosane, tricosane, tetracosane, pentacosane, hexacosane, heptacosane, octacosane, nonacosane, triacontane, dotriacontane, pentatriacontane, etc.; isoparaffins such as isobutane, isopentane, neopentane, isohexane, neohexane, 2,3-dimethylbutane, 2-methylhexane, 3-ethylpentane, 2,2-dimethylpentane, 2,4-dimethylpentane, 3,3-dimethylpentane, tributane, 2-methylheptane, 3-methylheptane, 2,2-dimethylhexane, 2,2,5-dimethylhexane, 2,2,3-trimethylpentane, 2,2,4-trimethylpentane, 2,3,3-trimethylpentane, 2,3,4-trimethylpentane, isononane and the like.

Examples of useful unsaturated hydrocarbons are olefins, such as ethylene, propylene, isobutylene, 1-butene, 2-butene, 1-pentene, 2-pentene, 2-methyl-1-butene, 3-methyl-1-butene, 2- methyl-2-butene, 1-hexene, tetramethylethylene, 1-heptene, 1-octene, 1-nonene, 1-decene and the like; diolefins such as allene, methylallene, butadiene, pentadiene, hexadiene, cyclopentadiene, and the like; triolefins such as ocimene, alloocimene, myrcene, hexatriene, and the like; and acetylene, methylacetylene, 1-butyne, 2-butyne, 1-pentyne, 1-hexyne, 1-heptyne, 1-octyne, 1-nonyne, 1-decyne, and the like.

Examples of useful alicyclic hydrocarbons are cycloparaffins such as cyclopropane, cyclobutane, cyclopentane, cyclohexane, cycloheptane, cyclooctane, cyclononane, cyclodecane, cycloundecane, cyclododecane, cyclotridecane, cyclotetradecane, cyclopentadecane, cyclohexadecane, and the like; cycloolifins such as cyclopropene, cyclobutene, cyclopentene, cyclohexene, cycloheptene, cyclooctene, cyclononene, cyclodecene and the like; terpenes such as limonene, terpinolene, phellandrene, sylvestrene, thujene, carene, pinene, bornylene, camphene, fenchene, cyclofenchene, tricyclene, bisabolene, zingiberene, curcumene, humulene, cadinene sesquibenihene, selinene, caryophyllene, santalene, cedrene, camphorene, phyllocladene, podocarpene, mirene and the like; steroids, etc.

Examples of useful aromatic hydrocarbons are benzene, toluene, xylene, hemimellitene, pseudocumene, mesitylene, prehnitene, isodurene, durene, pentamethylbenzene, hexamethylbenzene, ethylbenzene, propylbenzene, cumene, styrene, biphenyl, terphenyl, diphenylmethane, triphenylmethane, dibenzyl, stilbene, indene, naphthalene, tetralin, anthracene, phenanthrene, and the like.

The amorphous carbon film (hereinafter referred to as "a-C film") covering the triboelectrically charging member of the present invention is formed by plasma polymerization a single organic compound containing fluorine atoms, or plasma polymerization of a vaporized compound mixture containing a fluorine compound and a compound containing at least hydrogen and carbon so as to form an a-C film which incorporates fluorine atoms in its structure. A triboelectrically charging member can be prepared in this manner which possesses a high degree of hardness and superior surface release properties and which is excellent in triboelectrically chargeability. The triboelectrically charging member of the present invention is therefore damage and wear resistant, maintains copy image quality over time and provides a thin toner layer of uniform thickness on the developing roller over time, thus avoiding adhesion of fused toner on said developing roller. These fluorine incorporating compounds and hydrocarbons need not always be in a gaseous phase at room temperature and atmospheric pressure but can be in a liquid or solid phase insofar as they can be vaporized on melting, evaporation or sublimation, for example, by heating or in a vacuum.

Carrier gases may be used in addition to the above compounds and hydrocarbons. Examples of suitable carrier gases are Ar, Ne, He and the like.

According to the present invention, the gases of starting materials are made into an a-C film, most preferably via a plasma which is produced by d.c., low-or high-frequency, microwave or like plasma process. Alternatively, the film may be formed via ions which are produced by the ionization deposition, ion-beam, deposition or like process, or via neutral particles produced by a pressure decreasing CVD process, a vacuum evaporation process, sputtering process or the like. These processess may be used in combination.

The triboelectrically charging member of the invention can be obtained with a thin uniform film since it is formed by plasma polymerization, said member having extremely good adhesion with the toner thickness regulating member. Accordingly, reliability is improved vis-a-vis separation, deformation and the like.

The quantity of fluorine atoms incorporated into the a-C film of the invention is 1 to 70 atomic %, and preferably 2 to 40 atomic %, based on the total constituent atoms of the structure. When the quantity of fluorine atoms is less than 1 atomic %, suitable triboelectrical chargeability and release properties cannot necessarily be assured, and toner charging is reduced which gives rise to copy image fogging. When the quality of fluorine atoms exceeds 70 atomic %, film formability cannot be assured and film separation, oiliness and powdering may result.

Further, a triboelectrically charging member having different triboelectric charging characteristics can be obtained by varying the quantity fluorine atoms contained by the a-C film.

The quantity of fluorine atoms contained in the a-C film of the present invention can be controlled, in the case of plasma-polymerization of a vaporized fluorine-incorporating organic compound only, by using compounds which have different fluorine contents, or by selectably changing the conditions of the plasma polymerization process. When film formation is performed together with hydrocarbon compounds, the quantity of fluorine atoms incorporated in the a-C film is chiefly controlled by increasing and decreasing the volume of said gaseous fluorine mixture introduced into the reactor wherein the plasma polymerization reaction occurs. When the inflow volume of the aforesaid gas is increased, the quantity of fluorine atoms added to the a-C film to the invention can be increased, and conversely, when the input volume of said compound is reduced, the quantity of fluorine atoms added to the a-C film of the invention can be decreased.

The hydrogen content of the a-C film of the invention is variable in accordance with the film forming apparatus and film forming conditions. The hydrogen content can be decreased, for example, by elevating the substrate temperature, lowering the pressure, reducing the degree of dilution of the starting materials, applying a greater power, decreasing the frequency of the altering electric field to be set up, increasing the intensity of a d.c. electric field superposed on the alternating electric field, or a desired combination of such procedures.

More specifically, the hydrogen content is about 0.1 to 67 atomic %, more preferably about 1 to 60 atomic %, and most preferably about 30 to 60 atomic %, based on all the constituent atoms in the film. If the hydrogen content exceeds 67 atomic %, film formation decreases, whereas a hydrogen content below 0.1 atomic % leads to lower chargeability.

The structure of the a-C film of the present invention and the contents of carbon, hydrogen and fluorine atoms therein can be determined by a usual method of elementary analysis, for example, by organic elementary analysis, Auger electron spectroscopy, infrared absorption spectrum analysis, x-ray analysis, $^{1}$H-NMR, $^{13}$C-NMR and the like.

The thin a-C film of the invention having a thickness of about 1 to 200 μm, preferably about 5 to about 100 μm, can impart a satisfactory charge to the toner, and can also form a thin toner layer. When the a-C film is less than 1 μm in thickness, triboelectrical chargeability is reduced and the toner cannot be adequately charged, whereas a thickness which exceeds 200 μm is undesirable from a production standpoint.

Figure 2:
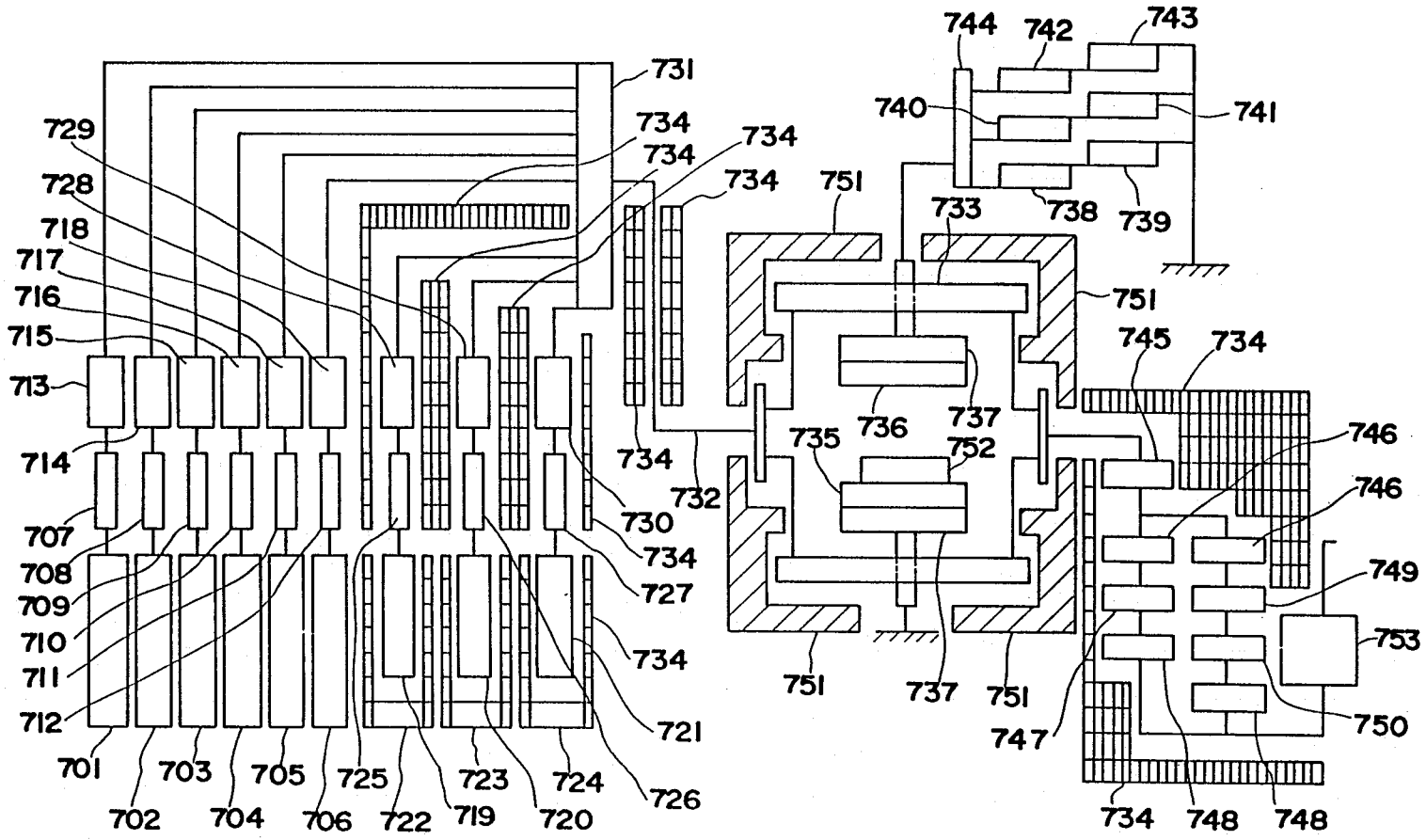
FIG. 2 shows a brief example of the apparatus for preparing the a-C film of the present invention.

FIG. 2 shows an apparatus for producing the a-C film of the present invention. The first to sixth tanks 701 to 706 in the drawing have enclosed therein starting material compounds which are in gas phase at room temperature and a carrier gas, and are connected respectively to the first to sixth regulator valves 707 to 712 and first to sixth flow controllers 713 to 718. First to third containers 719 to 721 contain starting material compounds which are liquid or solid at room temperature, which can be preheated by first to third heaters 722 to 724 for vaporizing the compounds, and are connected to the seventh to ninth regulator valves 725 to 727 and the seventh to ninth flow controllers 728 to 730, respectively. The gases to be used as selected from among these gases are mixed in a mixer 731 and fed to a reactor 733 via a main pipe 732. The interconnecting piping can be heated by a pipe heater 734 which is suitably disposed so that the material compound, in a liquid or solid phase at room temperature and vaporized by preheating, will not condense during transport. A grounded electrode 735 and a power electrode 736 are so arranged that they oppose each other within the reactor 733. Each of these electrodes can be heated by an electrode heater 737. The power application electrode 736 is connected to a high-frequency power source 739 via a high-frequency power matching device 738, to a low-frequency power source 741 via a low-frequency power matching device 740, and to a direct current power source 743 via a low-pass filter 742. Power of one of the different frequencies is applicable to the electrode 736 by way of a connection selecting switch 744. The internal pressure of the reactor 733 is adjustable by a pressure control valve 745. The reactor 733 is evacuated by a diffusion pump 747 and an oil rotary pump 748 via an exhaust system selecting valve 746, or by a cooling-removing device 749, a mechanical booster pump 750 and an oil rotary pump 748 via the exhaust system selecting valve 746. The exhaust gas is further made harmless by a suitable removal device 753 and then released to the atmosphere. The evacuation piping system can also be heated by a suitably disposed pipe heater 734 so that the material compound which is liquid or solid at room temperature and vaporized by preheating will not condense during transport. For the same reason, the reactor 733 can also be heated by a reactor heater 751. An electrically conductive substrate 752 is placed on the electrode in the reactor. Although FIG. 2 shows that the substrate 752 is fixed to the grounded electrode 735, the substrate may be attached to the power application electrode 736 or to both electrodes.

The reactor for preparing the a-C film is first evacuated by the diffusion pump to a vacuum of about $10^{-4}$ to about $10^{-6}$ torr, whereby the absorbed gas within the reactor is removed. The reactor is also checked for the degree of vacuum. At the same time, the electrodes and the substrate fixedly placed on the electrode are heated to a predetermined temperature by the electrode heater. Subsequently, material gases are fed into the reactor from the first to sixth tanks and first to third containers (i.e. from those concerned) each at a specified flow rate using the first to ninth flow controllers, and the interior of the reactor is maintained in a predetermined vacuum by the pressure control valve. After the combined flow of gases has become stabilized, the high-frequency power source, for example, is selected by the connection selecting switch to apply a high-frequency power to the power application electrode. This initiates a discharge across the two electrodes, forming a solid film on the substrate with time. The thickness of the film is controllable by varying the reaction time, such that the discharge is discontinued upon the thickness reaching the desired value.

Next the regulator valves concerned are closed, and the reactor is throughly exhausted. When an a-C film of the desired structure has been formed according to the invention, the vacuum within the reactor is vitiated and the film is removed from the reactor.

The a-C film of the present invention may contain alkaline metals or elements in Groups IIIA or VA of the Periodic Table of the Elements as a chemical modifier. Doping of such dopants improves triboelectrical chargeability.

The present invention will be described hereinafter with reference to the following examples.

Example 1

Film Forming Step

The glow discharge decomposition apparatus shown in FIG. 2 was used. First the interior of the reactor 733 was evacuated to a high vacuum of approximately $10^{-6}$ torr, and the seventh regulator valve 725 was thereafter opened to introduce 1H,1H,5H-octafluoropentylmethacrylate $[CH_2{=}C(CH_3)COOCH_2(CF_2)_4H]$ gas, heated by the first heater 722 to a temperature of 75° C., from the first container 719 into the seventh flow controller 728. The dial on the flow controller was adjusted to supply the 1H,1H,5H-octafluoropentylmethacrylate gas at a flow rate of 6.8 sccm to the reactor 733 through the main pipe 732. Following stabilization of the gas flow, the internal pressure of the reactor 733 was adjusted to 0.25 torr by the pressure control valve 745. On the other hand, the substrate 752 was used, said substrate being a ribbon-shaped steel material measuring 30 mm in length, 230 mm in width and 0.2 mm in thickness, was preheated to 160° C. With the gas flow rate and the pressure in stabilized states, 100-watt power with a frequency of 30 KHz was applied to the power application electrode 736 from the low-frequency power source 741 pre-connected thereto by the selecting switch 744 to conduct plasma polymerization for approximately 180 min, forming an a-C film 9 μm in thickness on the substrate 752, whereupon the power supply was discontinued, the regulator valves were closed, and the reactor 733 was fully exhausted.

When subjected to quantitative analysis, the a-C film thus obtained was found to contain 31 atomic % of hydrogen atoms, 24 atomic % of fluorine atoms and 5 atomic % of oxygen atoms based on the total combined constituent atoms therein.

Figure 3:
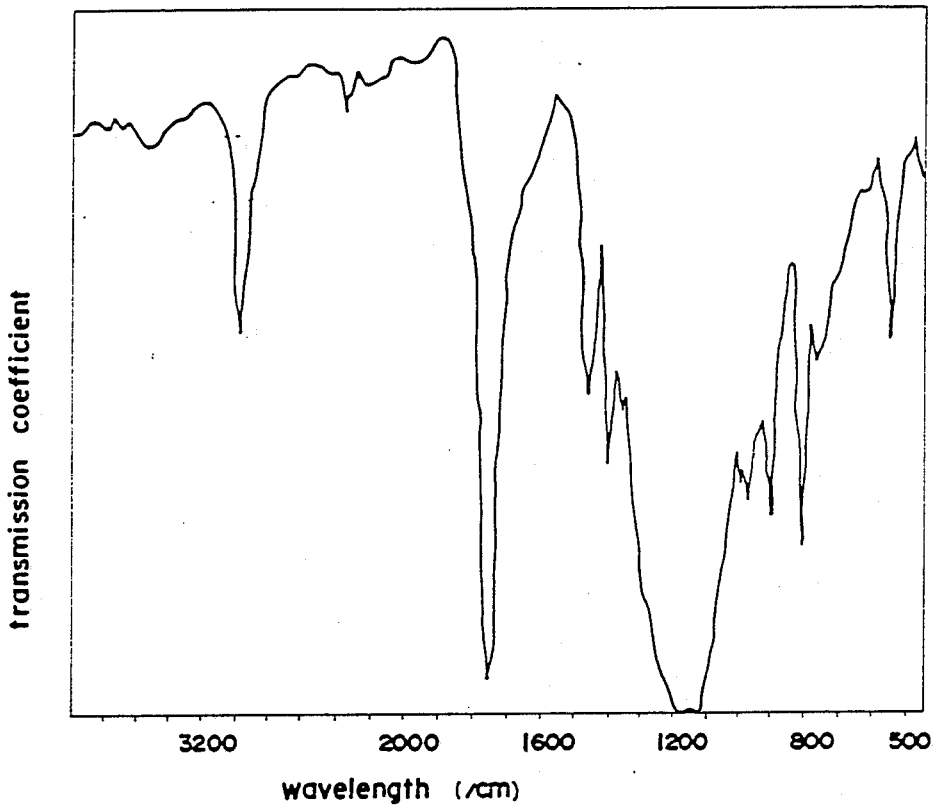
FIG. 3 shows a single example of the infrared spectrum for the a-C film of the invention.

Further, this film has an infrared absorption spectrum shown in FIG. 3.

Moreover, upon measurement of the hardness by a pencil durometer, this film was found to have a hardness rating of 6H.

Characteristics:

When the obtained ribbon-shaped steel substrate covered by the a-C film was installed as a toner thickness regulating member in a monocomponent developing apparatus in an electrophotographic copying machine and subjected to copy image formation and transfer in a normal Carlson process, sharp, high resolution copy images were obtained without any traces of striped irregularities in image density, grainy fog, or whiteout lines.

Furthermore, the same sharp copy images were obtained after 100,000 copies. No damage, wear or toner adhesion was observed under microscopic examination.

It is understood from the above results that the plasma-polymerized film of the present invention as described in the present example possesses excellent performance as a triboelectrically charging member.

Examples 2 to 10

The a-C films were prepared in substantially the same manner as described in Example 1.

Table 1 shows the various condition values for forming an a-C film.

More specifically, Table 1 shows the conditions which are different from Example 1 for forming an a-C film, said differences being classified into 17 items labeled 1 to 17. These items are described at the top column of Table 1. Some of the condition values shown in each item are common to each example, while others vary in each example.

Table 1 shows the items 1 to 17 as follows:

(1) Flow rate of hydrogen gas from the first tank 701 (sccm)
(2) Flow rate of material gas from the second tank 702 (sccm)
(3) Flow rate of dopant gas from the third tank 703 (sccm)
(4) Flow rate of dopant gas from the first container 719 (sccm)
(5) Flow rate of dopant gas from the second container 720 (sccm)
(6) Temperature of the first heater 722 (° C.)
(7) Temperature of the second heater 723 (° C.)
(8) Pressure (torr)
(9) Temperature of the substrate (° C.)
(10) Dimension of the substrate (length × width × thickness) (unit: mm)
(11) Frequency from the power source (Hz)
(12) Time for plasma polymerization
(13) Power (watt)
(14) Thickness of the film (micron)
(15') Hardness (H)
(16) Hydrogen content (atomic %) P1 (17) & (18) Content of the dopant contained in the a-C film (atomic %)

When the characteristics of the triboelectrically charging members obtained in Examples 2 to 10 were examined in the same manner as described in Example 1, results similar to those of Example 1 were obtained.

It is understood from the above examples that plasmapolymerized film of the present invention possesses excellent properties as a triboelectrically charging member.

TABLE 1

| Ex. No. | (1) sccm | (2) sccm | (3) sccm | (4) sccm | (5) sccm | (6) °C. | (7) °C. | (8) Torr | (9) °C. | (10) mm |
|---|---|---|---|---|---|---|---|---|---|---|
| 2 | — | — | — | (A)10 | — | 75 | — | 0.25 | 160 | 30 × 230 × 0.2 |
| 3 | — | — | — | (A)15 | — | 75 | — | 0.25 | 160 | 30 × 230 × 0.2 |
| 4 | — | — | — | (A)6.8 | — | 75 | — | 0.25 | 250 | 30 × 230 × 0.2 |
| 5 | — | — | — | (A)6.8 | — | 75 | — | 0.25 | 250 | 30 × 230 × 0.2 |
| 6 | — | — | — | (B)20 | — | 30 | — | 0.25 | 250 | 30 × 230 × 0.2 |
| 7 | $H_2$40 | $C_2H_4$30 | $CF_4$ 120 | — | — | — | — | 1.0 | 250 | 30 × 230 × 0.2 |
| 8 | $H_2$40 | $C_2H_4$30 | — | (A)10 | — | 70 | — | 0.8 | 200 | 30 × 230 × 0.2 |
| 9 | — | — | — | (A)20 | $C_5H_8$70 | 70 | 40 | 0.9 | 100 | 30 × 230 × 0.2 |
| 10 | $H_2$60 | $C_4H_6$20 | — | (A)20 | — | 70 | — | 1.0 | 200 | 30 × 230 × 0.2 |

| Ex. No. | (11) Hz | (12) | (13) watt | (14) μm | (15) H | (16) at. % | (17) at. % | | (18) at. % | |
|---|---|---|---|---|---|---|---|---|---|---|
| 2 | 30K | 180 m | 100 | 12 | 6 | 17 | F | 29.5 | 0 | 3.3 |
| 3 | 30K | 180 m | 100 | 20 | 7 | 10 | F | 38 | 0 | 1.2 |
| 4 | 30K | 180 m | 100 | 4 | 7 | 22.5 | F | 13.6 | 0 | 0.8 |
| 5 | 13.56 M | 60 m | 50 | 10.5 | 5 | 33.5 | F | 23 | 0 | 4.5 |
| 6 | 13.56 M | 60 m | 50 | 20 | 6 | 34 | F | 17.5 | 0 | 5.5 |
| 7 | 13.56 M | 5 h | 200 | 20 | 7 | 47 | F | 3.1 | — | — |
| 8 | 50 K | 3 h | 100 | 13 | 6 | 48 | F | 12.6 | — | — |
| 9 | 30 K | 30 m | 50 | 25 | 6 | 44 | F | 5.7 | — | — |
| 10 | 200K | 45 m | 100 | 25 | 6 | 35 | F | 15 | — | — |

(1) (A) means 1H, 1H, 5H - octafluoropenthylmethacrylate [$CH_2{=}C(CH_3)COOCH_2(CF_2)_4H$] gas.
(2) (B) means 2, 2, 2- trifluoroethylmethacrylate [$CH_2{=}C(CH_3)COOCH_2CF_3$] gas.
(3) $C_2H_4$ at column (2) means ethylene.
(4) $C_4H_6$ at column (2) means butadiene.
(5) $C_5H_8$ at column (5) means stylene.

Comparative Example

Ribbon-shaped steel substrates (30×230×0.2 mm) had the following films approximately 100 μm in thickness affixed to their surfaces by adhesive tape:

(A) polytetrafluoroethylene film
(B) silicon resin film
(C) polyamide resin film When the above members were tested by the methods described in Example 1, copy image quality deteriorated after several thousand copies with the appearance of striped irregularities in image density, whiteout lines, grainy fog and black lines in the image background.

Further, macroscopic and microscopic examinations revealed line-shaped wearing of the film, and mass or film-like toner adhesion to said layer.

What is claimed is:

1. A triboelectrically charging member including a surface formed with an amorphous carbon film containing at least carbon, hydrogen and fluorine atoms.

2. A triboelectrically charging member as claimed in claim 1 wherein the amorphous carbon film is formed by plasma polymerization with a glow discharge method.

3. A triboelectrically charging member as claimed in claim 1 wherein the amorphous carbon film contains fluorine atoms in an amount of about 1 to about 70 atomic % based on all the constituent atoms in the film.

4. A triboelectrically charging member as claimed in claim 1 wherein the amorphous carbon film contains hydrogen atoms in an amount of about 0.1 to about 67 atomic % based on all the constituent atoms in the film.

5. A triboelectrically charging member as claimed in claim 4 wherein the hydrogen content in the amorphous carbon film is preferably from about 30 to about 60 atomic % based on all the constituent atoms in the film.

6. A triboelectrically charging member as claimed in claim 1 wherein the amorphous carbon film has a thickness of about 1 to about 200 microns.

7. A triboelectrically charging member as claimed in claim 1 is used in a developing device of an electrophotographic copying machine which employs monocomponent developer, said developing device including a developing roller and said member being provided to be in contact with the developing roller for triboelectrically charging the developer to form a thin layer of the developer on the developing roller.

8. A member including a surface formed with an amorphous carbon film containing at least carbon, hydrogen and fluorine atoms, said member being used in developing device of an electrophotographic copying machine for triboelectrically charging developer.

* * * * *